US010968005B2

(12) United States Patent
Arregui Letamendi

(10) Patent No.: US 10,968,005 B2
(45) Date of Patent: Apr. 6, 2021

(54) GLASS BOTTLE

(71) Applicant: DSIGNTANK, S.L., Barcelona (ES)

(72) Inventor: Jokin Arregui Letamendi, Barcelona (ES)

( * ) Notice: Subject to any disclaimer, the term of this patent is extended or adjusted under 35 U.S.C. 154(b) by 34 days.

(21) Appl. No.: 15/518,561

(22) PCT Filed: Oct. 13, 2015

(86) PCT No.: PCT/IB2015/001865
§ 371 (c)(1),
(2) Date: Apr. 12, 2017

(87) PCT Pub. No.: WO2016/059460
PCT Pub. Date: Apr. 21, 2016

(65) Prior Publication Data

US 2017/0275044 A1 Sep. 28, 2017

(30) Foreign Application Priority Data

Oct. 13, 2014 (EP) ..... 14380032

(51) Int. Cl.
*B65D 1/02* (2006.01)
*B65D 1/00* (2006.01)
*B65D 1/04* (2006.01)

(52) U.S. Cl.
CPC ..... *B65D 1/0276* (2013.01); *B65D 1/02* (2013.01); *B65D 1/0207* (2013.01); *B65D 1/0223* (2013.01); *B65D 1/00* (2013.01); *B65D 1/04* (2013.01)

(58) Field of Classification Search
CPC ..... B65D 1/0276; B65D 1/02; B65D 1/0207; B65D 1/0261; B65D 1/04; B65D 13/02
USPC ..... 215/370, 371, 372, 373, 374, 376, 378; 220/600, 604, 605, 606, 608, 610, 612, 220/628, 633, 634, 635, 636
See application file for complete search history.

(56) References Cited

U.S. PATENT DOCUMENTS 1,416,347 A * 5/1922 Gregory ..... B65D 1/0276 215/373
2,631,747 A * 3/1953 Stolte ..... A63H 33/062 206/509
D652,721 S * 1/2012 Pelkey ..... D9/500
D687,302 S * 8/2013 Reynolds ..... D9/500
(Continued)

FOREIGN PATENT DOCUMENTS

DE 19721463 * 11/1998 ..... B65D 1/0276

*Primary Examiner* — James N Smalley
*Assistant Examiner* — Jennifer Castriotta
(74) *Attorney, Agent, or Firm* — Eugenio J. Torres-Oyola; Victor M. Rodriguez-Reyes; Rafael Rodriguez-Muriel

(57) ABSTRACT

A glass bottle body made up by a neck jointed in continuity to a receptacle tubular wall, said bottle body being closed by a bottom wall placed on a bottle end side opposite regarding said neck, defining said bottom wall a receptacle capable of holding liquids, characterised in that said bottom wall is extended, in a perimeter area, by a base tubular wall that internally defines a cavity, said base tubular wall and the receptacle tubular wall being in opposite sides of the bottom wall; and the average height of the base tubular wall being equal to or larger than the average thickness of the base tubular wall, being the contents of the bottle highlighted by two laterally visible layers of the bottom of the bottle, producing a stand effect.

19 Claims, 9 Drawing Sheets

(56) References Cited

U.S. PATENT DOCUMENTS

| | | | | |
|---|---|---|---|---|
| 2010/0084367 | A1* | 4/2010 | Rijnierse | B65D 1/0276 215/373 |
| 2017/0225821 | A1* | 8/2017 | Hynes | B65D 1/0261 |

* cited by examiner

PRIOR ART

PRIOR ART

GLASS BOTTLE

FIELD OF THE ART

The present invention relates to a glass bottle, the bottle being provided with a base tubular wall extended from the bottom wall of the bottle, rising the container and its contents.

STATE OF THE ART

Glass bottles are traditionally formed by a receptacle tubular wall, which forms the body of the bottle and is jointed in continuity to a bottom wall, which closes the container, and said receptacle tubular wall is also jointed in continuity to a bottle neck by its part opposite to the base, typically prepared to be capable of being hermetically sealed by means of a cap, whether made of cork, plastic, metal, rubber, glass, and fitted whether by pressure, threadedly or using another material or method.

Various bottom walls of glass bottles are known with different configurations and geometry, which typically have a swelling towards the inside of the bottle known in the art as punt, which confers them some characteristics of mechanical resistance, especially in sparkling wines, while the volume of the bottle is increased without increasing the volume of the liquid held therein, and other aesthetic and brand recognition advantages are also achieved.

In the case of the most pronounced punts, the hollow cavity created under the punt may become substantial, but, in any case, between the receptacle tubular wall and the swelled bottom wall will remain a tubular gap capable of containing liquid, so that the tubular walls delimiting the hollow cavity of these bottles with a substantial punt consist of a double layer of tubular walls (a first layer formed by the perimeter areas of the swelled bottom wall and a second layer formed by a lower fraction of the receptacle tubular wall), a tubular gap being left therebetween connected with the rest of the bottle and liable to be filled with liquid, thus hiding said bottom wall, said punt and said hollow cavity.

Bottle designs are also known wherein the bottom wall thickness is much larger than necessary for technical or mechanical requirements, said bottom wall being very visible from the side of the bottle. A few examples of this solution can be seen in documents U.S.D694637S1, U.S.D629692S1 or U.S.D559698S1. These designs intend to confer distinctive characteristics on the bottle, placing the held liquid above a thick glass base in order to visually highlight it, but these designs use common manufacturing techniques and produce very heavy bottles with a large consumption of material. These customary techniques simply use glass-blowing inside a mould, which, combined with the effect of gravity, produces the accumulation of glass at the base.

Document DE19721463 describes a bottle which includes a deep narrow groove surrounded by a cylindrical wall placed on the bottom part of the bottle, said groove intended to allow the insertion of a finger into said groove producing a gripping effect between the bottle and the finger. This effect can only be achieved in a small and light bottle, like the single shot bottles which typically contain 20 ml of liquid, and only having said groove a finger size.

Furthermore document DE19721463 describe two different bottle embodiments.

A first embodiment shown on FIG. 1 include a deep narrow groove surrounded by a cylindrical wall placed on the bottom part of the bottle closed by a pronounced punt in such a way that the bottom wall of the bottle is a pronounced cupola and is not visible from the lateral view of the bottle because the liquid contained in the annular groove surrounding said pronounced punt hide the bottom wall from the lateral point of view of a consumer, being only visible the receptacle tubular wall and the cylindrical wall surrounding the narrow groove being the bottom wall placed there between not visible.

A second embodiment shown on FIG. 2 is obtained by two different parts glued or welded together in such a way that the bottom wall of the bottle is formed by two different bottom walls joined together. In this case the bottom wall will be visible from a lateral point of view but the glue or the welding line of said joint will be also visible hiding part of the bottom wall or producing undesired light-diffracting effects which will not allow a visual effect of overlapped fringes having different luminous and light-diffracting properties.

As for the manufacturing technique, the blowing of molten glass inside a mould and the simultaneous suctioning of the air contained in the mould so as to compensate for the air introduced through blowing, thereby achieving the correct deposition of molten glass, is a widely known technique, for instance, from documents U.S. Pat. No. 2,448,632A or CN202482200, but these documents do not anticipate its use for forcing the deep introduction of the molten glass inside deep gaps of the mould base for the configuration of the support stand of the bottle.

Finally, document JPS6020332 shows a manufacturing technique of bottles with a base provided with a notch in the central area, but said technique does not allow the production of bottles with a perimeter wall on the base of the bottle with the proposed size and proportion, and, therefore, it does not allow or suggest the manufacture of bottles provided with the technical advantages derived from the utilisation of said perimeter wall on the base, as will be described below.

BRIEF DESCRIPTION OF THE INVENTION

The proposed invention relates to a glass bottle and the production method thereof.

The proposed glass bottle includes at least a body of the bottle, made up by a neck jointed in continuity to a receptacle tubular wall that defines an inner side and an outer side, and said body of the bottle being closed by an end opposite said neck by a bottom wall defining a receptacle capable of holding liquids, said receptacle tubular wall being joined to the perimeter of said glass bottom wall.

Thus, the body of the bottle contains the receptacle for liquids between said bottom wall and the tubular wall, which is rounded off by a bottle neck in the usual way in the field, said neck being capable of being hermetically sealed by means of a cap, top, applicator or dispenser, liable of being made of a plurality of materials, such as, for instance, cork, plastic, rubber, metal or glass. Said cap, top, applicator or dispenser may be fitted to the bottle by force, friction, clamps, threads or another usual method.

Obviously, the contents of the bottle may be, for instance, drinks, perfumes, creams—both for alimentary and cosmetic use—, the holding of water, spirits or wines being preferable.

In a distinctive manner in the proposed bottle, said bottom wall is extended, in a perimeter area, by a base tubular wall that internally defines a cavity, open to the outside by a distal end area and opposite said bottle neck, said base tubular wall and the receptacle tubular wall being in opposite sides of the bottom wall, the height of the base tubular wall being equal to or larger than the average thickness of said base tubular wall.

This distinctive characteristic provides a base tubular wall, extended from the bottom wall of the bottle, towards one side of the bottom wall opposite the side housing said receptacle for liquids. Said base tubular wall and the bottom wall define a cavity open towards the outside in its most distal side from the neck.

If the bottle were to be in a vertical position on a support plane, the opening of the cavity would be coincident with the support plane, the base tubular wall would provide support for the bottle on said support plane, the bottom wall would be spaced away from the support plane, and the receptacle and all the liquid held therein would be risen and spaced away from said support plane by said cavity and by the thickness of the bottom wall.

This characteristic and the distinctive proportions of the base tubular wall and the bottom wall, thanks to the different refraction of the light going through the base tubular wall, the bottom wall and the liquid held by the tubular walls of the bottle, makes it possible to notice the visual separation of three distinctive segments in the bottle, as seen laterally, the liquid being held on two visually distinguishable fringeswith different luminous and light-diffracting properties as seen laterally on the lower end of the glass bottle, one first fringe corresponding to the base tubular wall as seen laterally and one second fringe corresponding to the bottom wall as seen laterally.

This allows, on the one hand, better thermal isolation of the support plane liquid, since one same volume of liquid exposes a smaller surface, particularly relative to the usual solution of including a punt in the base, which increases the interface of the liquid with the outside, speeding up their thermal exchange. On the other hand, with this solution the visual highlighting of the bottle contents is achieved by placing the latter above a base of considerable height and of different levels, thereby achieving a stand effect. The overlap of two fringes with different luminous and light-diffracting properties, in the case of placing a coloured liquid in the container, makes it possible for the laterally visible colour of each of the fringes to be different when the bottle is crossed by the light, and all of it through a reduction of the glass that would be necessary to produce the same rising of the liquid if a solid bottom of great thickness was used in the bottle. This invention further allows the proposed bottle to have a larger volume and, therefore, greater visibility than a traditional bottle of the same capacity, which means a clear commercial advantage.

In one preferred though not limiting way, the average height of the base tubular wall is equal to or larger than the thickness of the base tubular wall in its proximal area of juncture with the bottom wall. That is, said base tubular wall is preferably taller than wide in its base of juncture to the rest of the bottle. This is relevant, since the thickness of the base tubular wall, as well as the angle its sides form relative to the sides of the bottom wall, in the area where both walls come together, determines the optical effects produced, and it is essential so that, from a lateral viewpoint outside the bottle, two clearly separated levels are noticeably formed by the bottom wall and by the base tubular wall, which highlight the contents of the bottle above those levels that create the above-mentioned stand effect.

The average thickness of the bottom wall and the average height of the base tubular wall are visible from the side of the bottle. The optical properties of the glass together with the existent rounded joints between the bottom wall and the receptacle tubular wall and the base tubular wall produce that the apparent thickness of the bottom wall, from a lateral viewpoint, appear to be larger than the real average thickness of the actual bottom wall due to an optical effect.

This optical effect is more efficient when the rounded joints placed on one or on both sides of the bottom wall (preferably both) have a radius of curvature equal or bigger than the average thickness of the bottom wall. As an example of this feature said rounded joints have a radius of curvature of 1 cm and the bottom wall has an average thickness of 0.5 cm.

Thanks to this optical effect the bottom wall thickness can be reduced maintaining an ostensibly apparent thickness of said bottom wall visible from the side of the bottle and saving glass.

According an extreme embodiment of this visual effect produced by said radius of curvature of the rounded joints, said radius of curvature of the rounded joint is equal or bigger than the half of the width of the hollow cavity. According this embodiment the bottom of the hollow cavity and the perimeter limits of the hollow cavity defined by the base tubular wall are curved and continuous, defining a hollow cupula, and producing an apparent thickness of the bottom wall much larger than the real average thickness of the bottom wall viewed from the bottle side.

An additional improvement of this optical effect can be achieved when the bottom wall is flat or when said bottom wall has a radius of curvature equal or longer than the average width of the hollow cavity, preferably two or more times longer than the average width of the hollow cavity. In a preferred embodiment a bottle has a bottom wall average thickness equal or smaller than the average thickness of the base tubular wall, and the apparent thickness of said bottom wall remains visible from the side of the bottle thanks to said radius of curvature of the rounded joint which is equal or bigger than the average thickness of the bottom wall.

Using this visual effect above described a different result can be obtained, producing an extreme reduction of the bottom wall thickness visible from the bottle side or even producing the visual disappearance of the bottom wall viewed from the bottle side. This effect can be achieved if the average thickness of the bottom wall is smaller than the average thickness of the base tubular wall and the rounded joint radius of curvature is smaller than said average thickness of the bottom wall. Under these circumstances the apparent thickness of said bottom wall visible from the side of the bottle is reduced, or even can disappear, being only visible the liquid retained into the receptacle and the base tubular wall. This visual disappearance of the bottom wall can be improved when the bottom wall has a curvature and a thickness such that the centre of the bottom of the hollow cavity is more distant to the opening of the cavity than the perimeter of the bottom of the receptacle. This visual effect can be a preferred effect therefore this dimensional relationship can be also preferred dimensional relationship.

According to one preferred embodiment, the bottom of the receptacle and the bottom of the cavity are substantially parallel, and, optionally or additionally, the bottom of the receptacle and/or the bottom of the cavity are substantially flat, so that said bottom wall is preferably flat and parallel to the support plane, in case the bottle is placed thereon. In order to get the correct lateral visibility of the two fringes of the bottom of the bottle, it is preferable for the average thickness of the bottom wall to be equal to or larger than the average thickness of the base tubular wall, or preferably equal to or larger than 1.5 times said average thickness of the base tubular wall. This characteristic further allows the bottom wall to have considerable thermal inertia, which makes it possible to slow down the heating or cooling of the liquid, thereby avoiding sudden temperature changes that might spoil said liquid.

It is likewise preferable for the average thickness of the base tubular wall to be larger than the average thickness of the receptacle tubular wall, or preferably equal to or larger than 2 times the average thickness of the receptacle tubular wall.

According to one additional or alternative embodiment, the depth of the cavity is equal to or larger than the average thickness of the bottom wall, or preferably equal to or larger than 1.5 times the average thickness of the bottom wall.

It is also preferred that the depth of the cavity be equal to or larger than two times the average thickness of the base tubular wall.

Also is preferred that the average width of the hollow cavity will be bigger than the average high of the base tubular wall. Also is preferred that said average width of the hollow cavity will be 4 cm, avoiding narrow spaces which can accumulate dirtiness.

Through these dimensional relationships, it is achieved that the bottom wall should have sufficient thickness to be clearly visible from the side of the bottle and that the cavity and the base tubular wall should be of a suitable size to achieve their correct lateral visibility. Other dimensional relationships would also be admissible, but they would be less preferable.

It is considered that the depth of the cavity and/or the thickness of the bottom wall should be at least 15 millimetres in the case of bottles with a capacity larger than 500 millilitres, and at least 10 millimetres in the case of bottles with a capacity ranging between 100 and 500 millilitres.

In one further embodiment, the distance between the bottom of the receptacle and the most distal end of the base tubular wall from the neck is equal to or larger than one fifth, or preferably one fourth of the total height of the bottle, excluding the neck, so that the base arrangement on which the receptacle is located is at least 20% or 25% of the total height of the bottle, not counting the neck (whose length may be quite variable).

The volume of the cavity will optionally be equivalent to at least 4% of the volume of the receptacle and, preferably, such a relationship of volumes will be at least 10%.

According to one further embodiment, the outer sides of the receptacle tubular wall and of the base tubular wall are mutually aligned and flush with the perimeter of the glass bottom, being, as a result, in continuity, the outside of the bottle being one continuous wall.

In one further alternative embodiment, said outer sides of the receptacle tubular wall and of the base tubular wall are tangent to each other.

In addition, or alternatively, the opening of the cavity has a smaller or larger-sized surface than the size of the cross-section of the receptacle in a position adjacent to said bottom wall, whereby the base tubular wall will have an increasing or decreasing section. The invention further relates to a manufacturing method of a glass bottle like the one described above that includes:

- arranging a mould formed by at least two segments susceptible of mutual engagement, forming a moulding cavity defined by inner mould walls and by a mould bottom that define at least an outer side of the glass bottle to be made, and said at least two segments being susceptible of mutual separation so as to release a bottle manufactured in said moulding cavity; said moulding cavity being provided with a blowing aperture in a position matching the neck of the bottle to be made;
- arranging a predetermined amount of molten glass inside said moulding cavity;
- applying said molten glass against said inner mould walls and against said mould bottom by blowing a fluid inside said predetermined amount of molten glass through the blowing aperture, said blowing aperture being connected to blowing means;
- demoulding the manufactured bottle, formed at least by a receptacle tubular wall jointed in continuity to a bottom wall and to a neck.

The procedure so far described is a procedure known in the art, but the following distinctive characteristics are further proposed:

- the mould bottom features a deep annular perimeter groove whose depth is equal to or larger than its average width;
- the mould consists of at least three segments: one first segment makes up the mould bottom, and at least two other segments make up the inner walls of the mould, a defined annular groove being left, at least partially, between the first segment and the at least two other segments; and
- because the molten glass is fed into said annular groove through suction applied from the base of the annular groove through suction openings connected to suction means, the glass fed into said annular groove making up a glass base tubular wall jointed in continuity to the bottom wall of the manufactured bottle.

The blowing means and the suction means may be, by way of example, an air pump, a pressurised tank or a vacuum tank, or other equivalent means.

The predetermined amount of molten glass will preferably be provided as a parison having a neck, a receptacle tubular wall and a bottom wall, defining a receptacle open to the outside through said neck, and said parison will be arranged inside the mould, leaving the neck trapped inside the blowing aperture of the mould, so that the blowing of the molten glass can be effected through said neck.

This technique allows the manufacture of a bottle with the characteristics described above on an industrial scale susceptible to being automated for mass production, thanks to the fact that the use of suction provides the assurance of the proper moulding of the base annular wall; without the use of said suction, the base tubular wall would hardly be mouldable, or it would present frequent flaws, and it would hamper or prevent its automated production in high-speed assembly lines.

It is further proposed that the thickness of the bottom wall and of the receptacle tubular wall of the bottle to be manufactured be controlled through the adjustment of the blowing velocity and/or the cooling speed of the molten glass and/or the initial viscosity of the molten glass.

As a skilled artisan will understand and find obvious, the bottle can have a circular, square, rectangular, elliptic, oval, hexagonal, octagonal section, or one of any other regular or irregular polygonal or rounded shape, without affecting the scope of the present invention. Said cross-section may likewise be constant along the entire length of the bottle, or it may be of variable size or shape.

It shall be understood that references to geometrical positions, such as, for instance, parallel, perpendicular, tangent, etc., admit deviations of up to ±5° relative to the theoretical position defined by said designation.

Other characteristics of the invention will appear in the following detailed description of one exemplary embodiment.

BRIEF DESCRIPTION OF THE DRAWINGS

The above and other advantages and characteristics will be more fully understood from the following detailed description of one exemplary embodiment with reference to the attached drawings, which must be taken by way of illustration and not limitation, wherein.

DETAILED DESCRIPTION OF AN EXEMPLARY EMBODIMENT

Figure 2A:
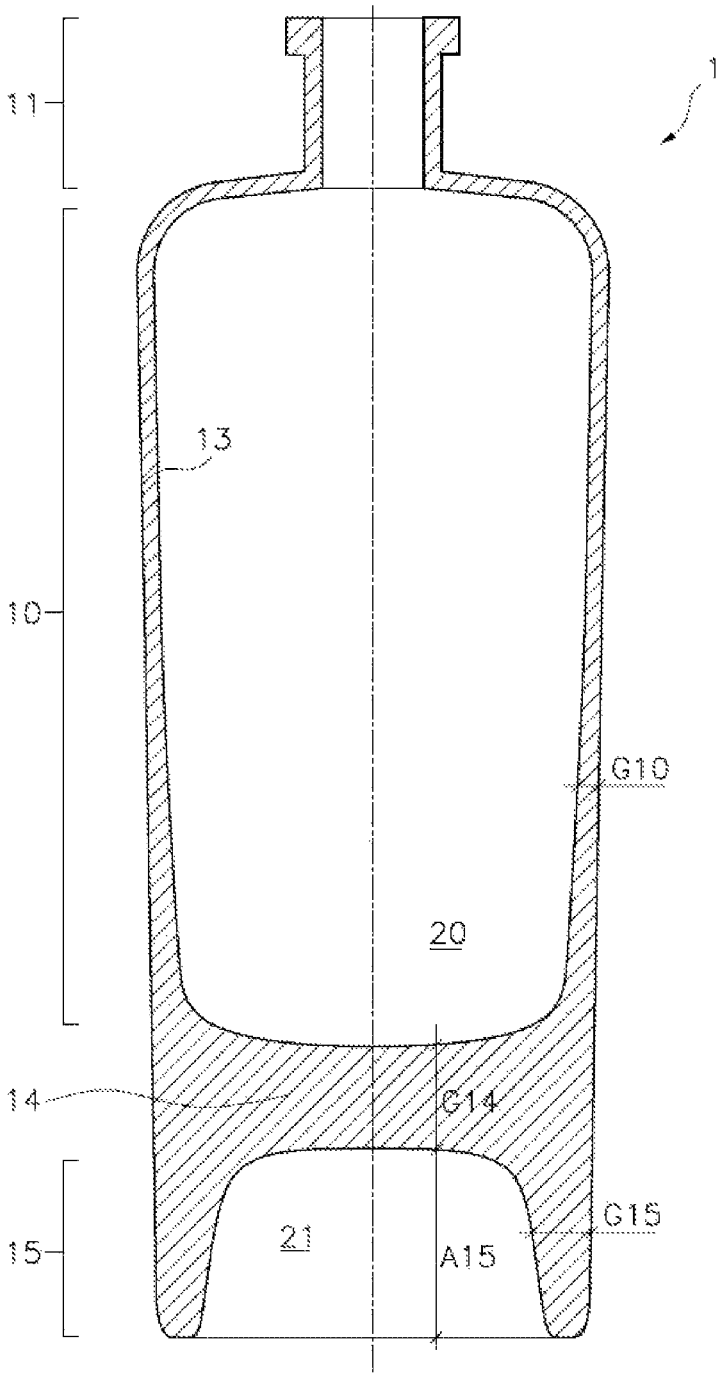
FIG. 2A shows a longitudinal section of an exemplary embodiment of the glass bottle proposed in the present invention.
Figure 2B:
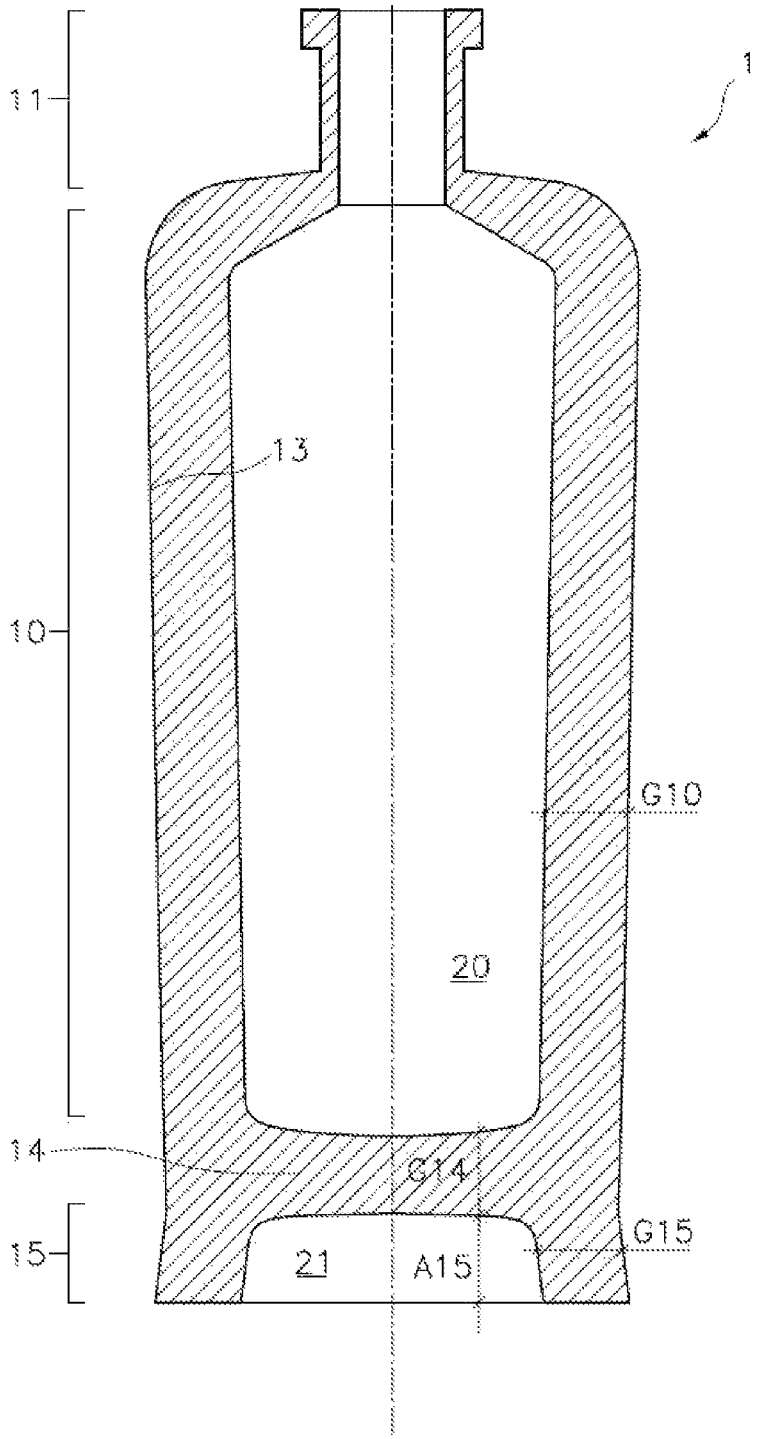
FIG. 2B shows a longitudinal section of an alternative embodiment of the glass bottle proposed in the present invention.
Figure 3A:
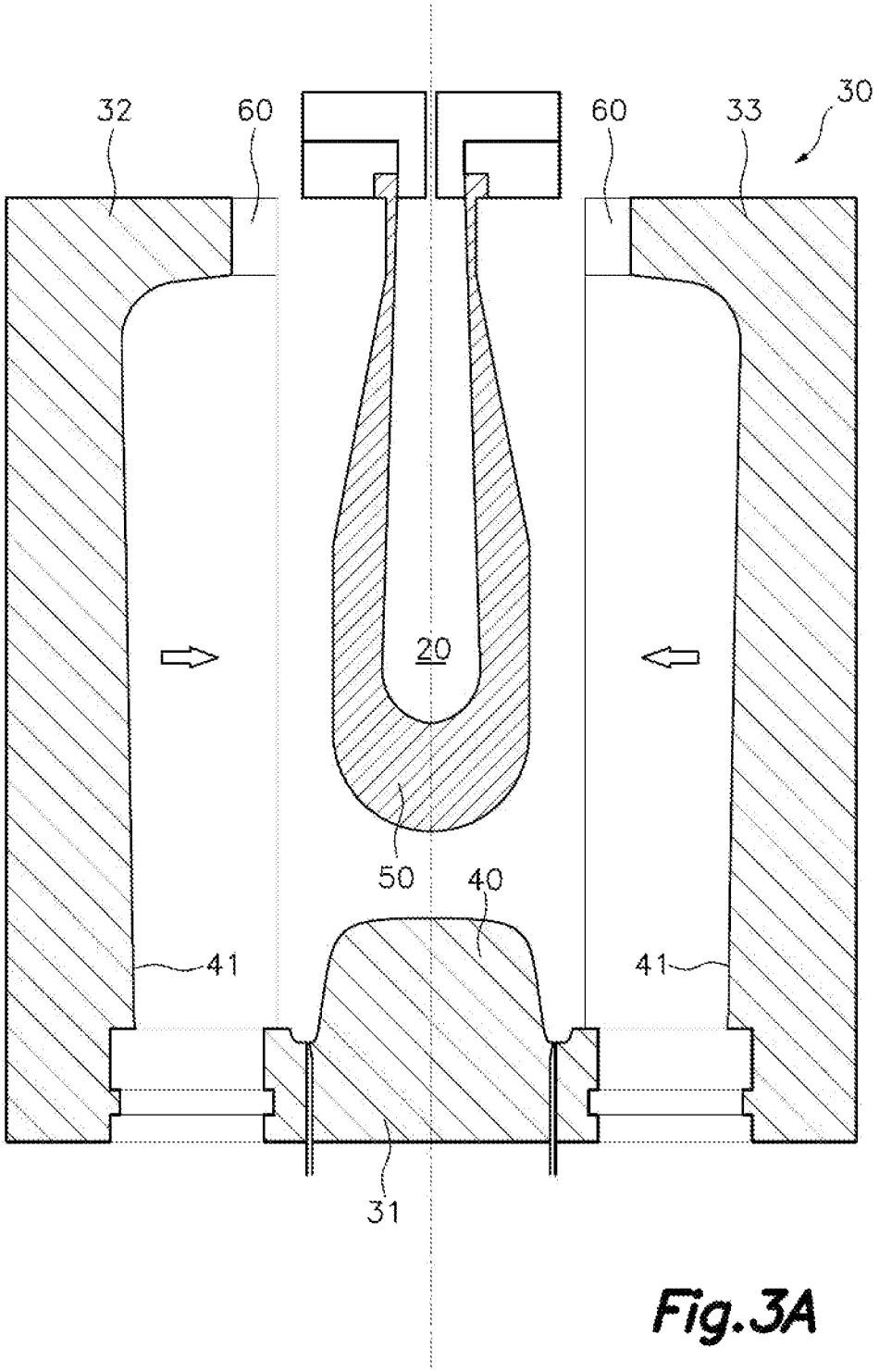
FIG. 3*a* shows a first manufacturing step of the proposed glass bottle wherein the at least three segments making up the mould are separated, and a predetermined amount of molten glass is arranged among the at least three mould segments, said predetermined amount of glass being a parison.
Figure 3B:
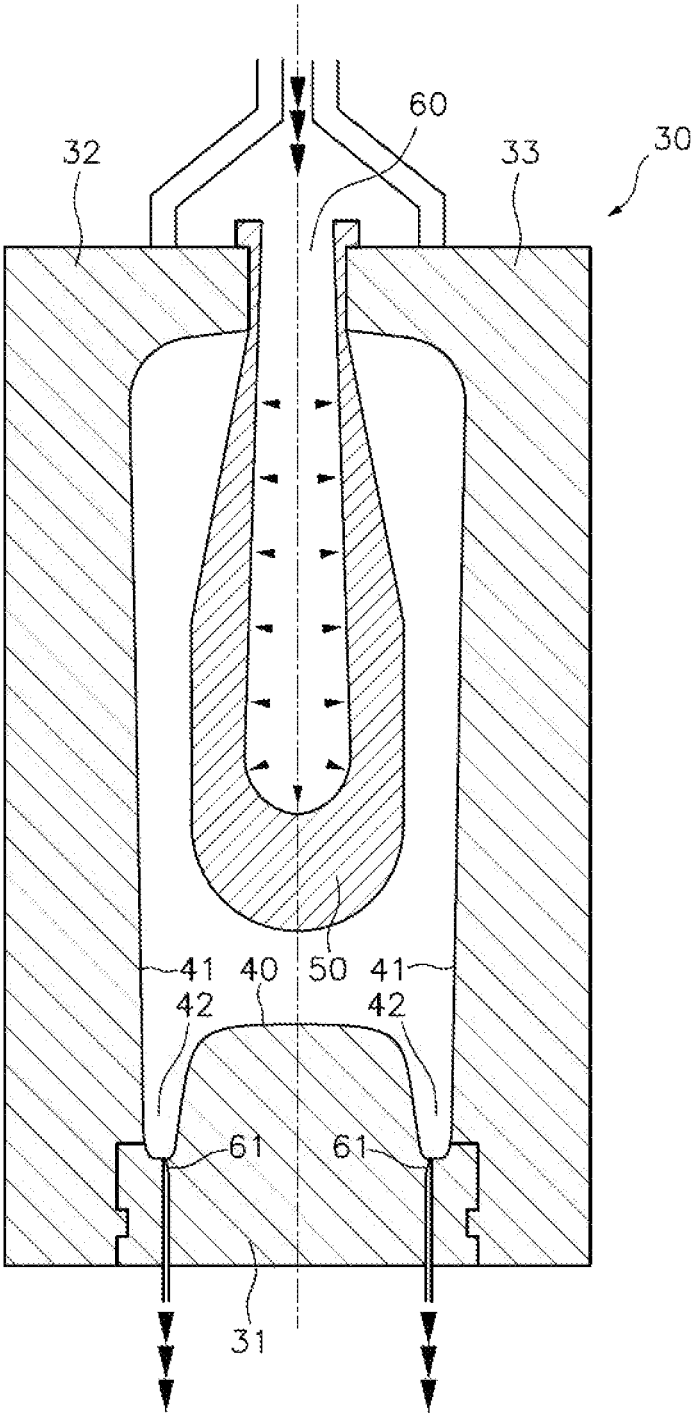
FIG. 3*b* shows a second manufacturing step of the proposed glass bottle wherein the segments that make up the mould have been attached to one another, making up the moulding chamber, into which that predetermined amount of molten glass is being applied against the inner walls of the mould through the blowing carried out through the blowing aperture and by means of the suction carried out through the suction openings.
Figure 3C:
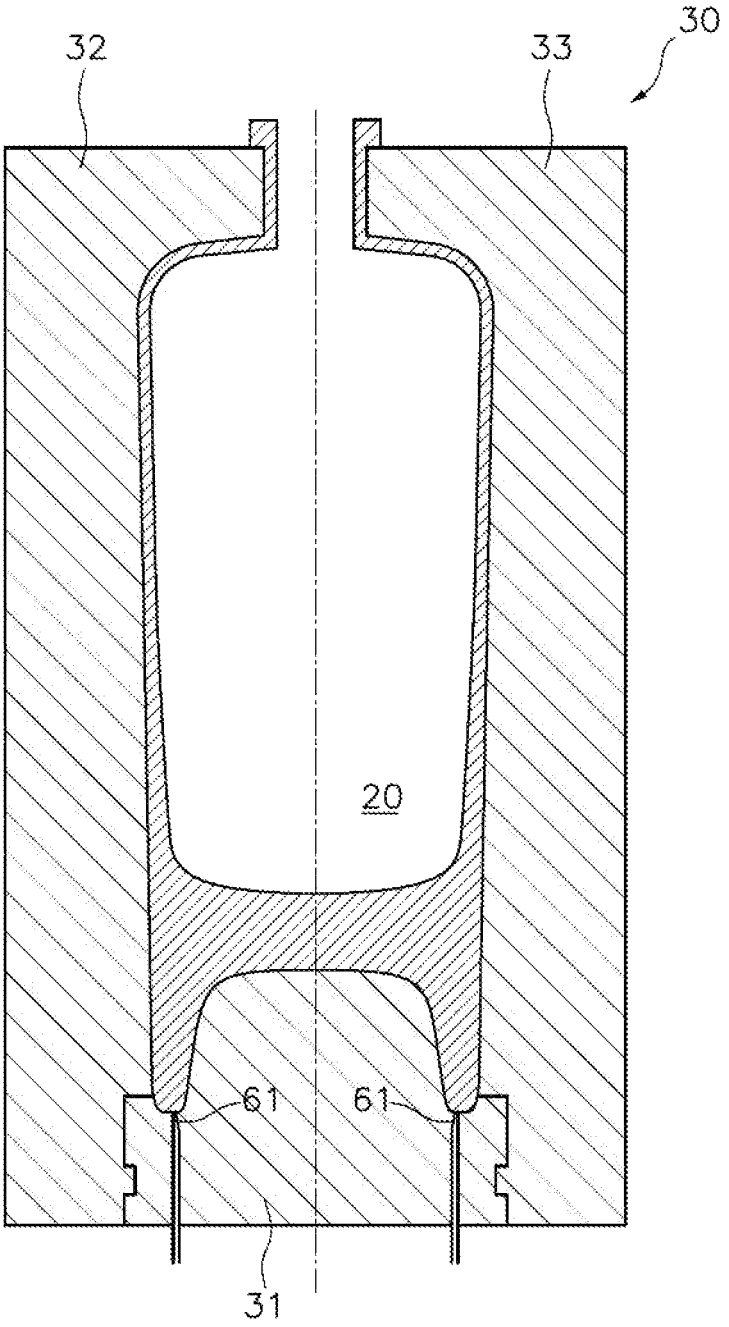
FIG. 3*c* shows a third manufacturing step, prior to the demoulding, wherein the bottle to be manufactured has been fully made up inside the mould.

According to a non-limiting exemplary embodiments shown in FIGS. 2A and 2B, there is proposed a glass bottle 1 suitable for holding liquids, such as drinks or perfumes, said bottle 1 being formed by a neck 11 jointed in continuity to a receptacle tubular wall 10 through, for instance, transitional shoulders, and the receptacle tubular wall 10 being jointed in continuity to a bottom wall 14. The juncture of the neck 11, the receptacle tubular wall 10 and the bottom wall 14 defines the receptacle 20 therein destined to hold liquids.

The neck 11 is prepared to be capable of being hermetically sealed by means of a cap, in this exemplary embodiment by means of a cork cap inserted by means of force-fitting in said neck, but other materials, such as glass, are also very commonly used.

In the FIG. 2A exemplary embodiment, the receptacle tubular wall 10 is a hollow cylinder and the bottom wall 14 is circular, their diameters being coincident and the receptacle tubular wall 10 being joined to the perimeter of the bottom wall 14.

The bottom wall 14 is extended by a base tubular wall 15, located on one side of said bottom wall 14 opposite that of the bottom wall 14 joined to the receptacle wall 10 and delimiting the receptacle 20. Said base tubular wall 15 and said bottom wall 14 define a hollow cavity 21 that opens and communicates with the outside by a distal end of the base tubular wall 15, whose edge defines the opening of said cavity 21, which is located in a position of the bottle 1 opposite the position occupied by the neck 11.

In this exemplary embodiment, the average height of the base tubular wall A15 is about 2.5 times the average thickness of the base tubular wall G15. Likewise, the bottom wall 14 is substantially flat and the average thickness of the bottom wall G14 is about 1.5 times the average thickness of the base tubular wall G15.

These proportions give origin to a bottle 1 with a thick bottom wall 14 supported on a slender base tubular wall 15, both the average thickness of the bottom wall G14 and the average height of the base tubular wall A15 being ostensibly visible from the side of the bottle 1. In fact, the optical properties of the glass, together with the existent rounded joints between the bottom wall 14 and the receptacle tubular wall 10 and the base tubular wall 15, cause, from a lateral viewpoint, the apparent thickness of the bottom wall 14 to be larger than the average thickness of the actual bottom wall G14, due to an optical effect.

Figure 4:
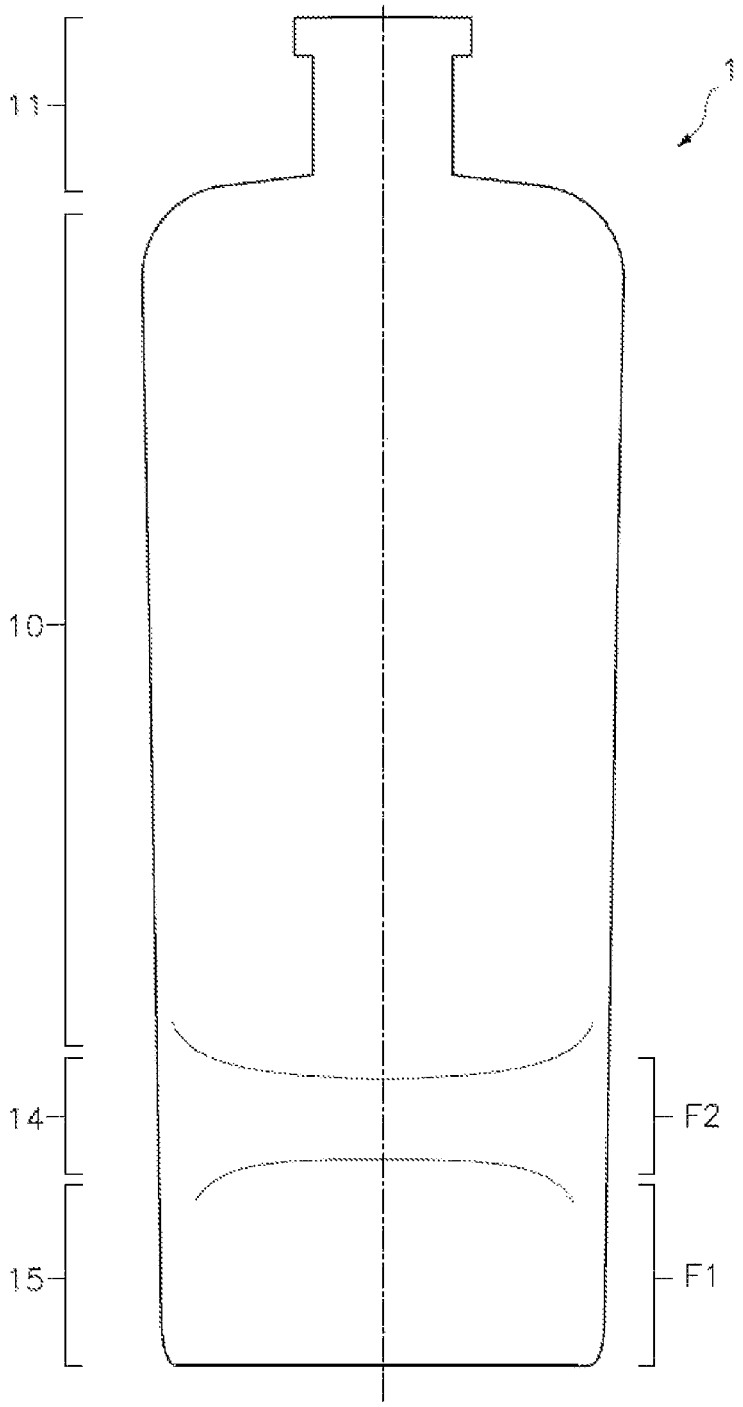
FIG. 4 shows a lateral view of the glass bottle shown on FIG. 2A.
Figure 5A:
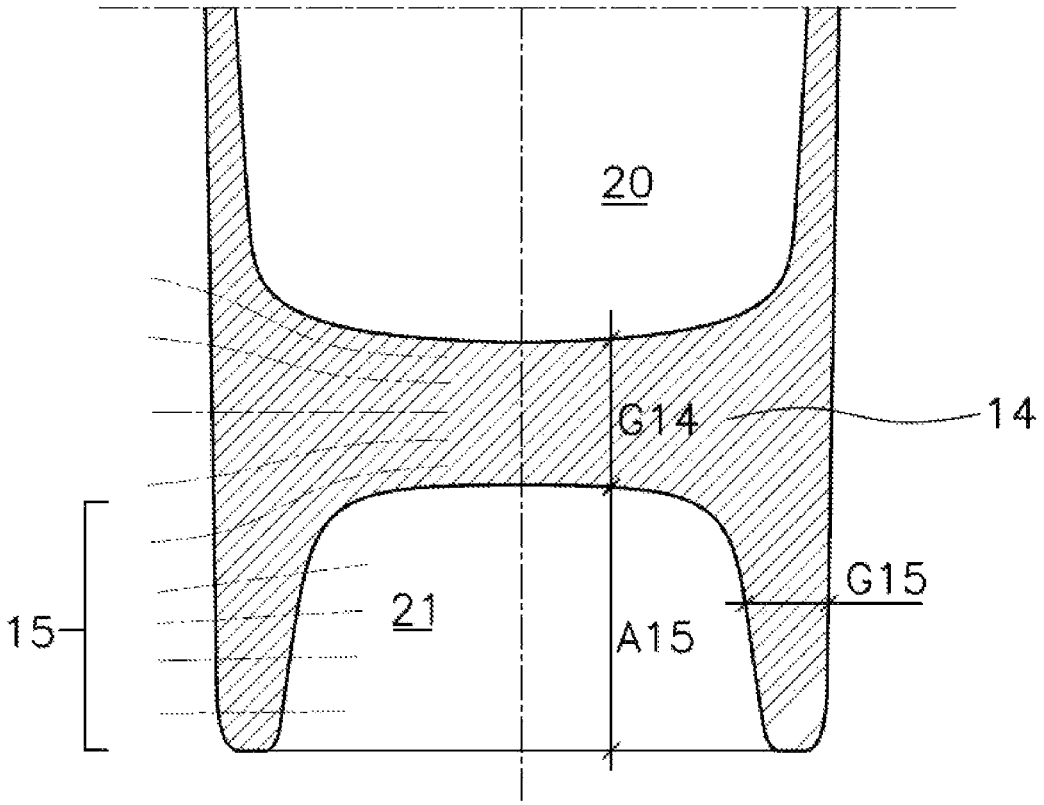
FIG. 5A shows a detail View of the base of the glass bottle shown on Fig. 2A, including dashed lines indicative of the diffraction of the light passing through the base of the glass bottle.
Figure 5B:
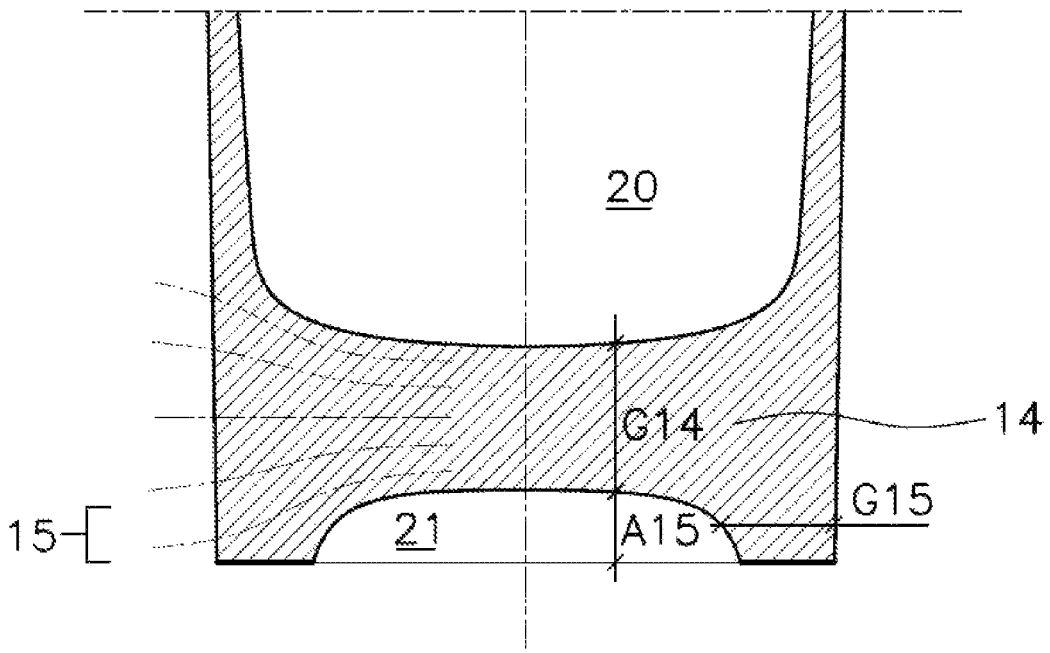
FIG. 5B shows a detail View of the base of the glass bottle according to the state of the art.

Said bottom wall 14 and base tubular wall 15 have distinctive optical behaviour as seen laterally producing two overlapped visually distinguishable fringes, a first fringe F1 corresponding to the base tubular wall 15 as seen laterally and a second fringe F2 corresponding to the bottom wall 14 as seen laterally. Those first and second fringes F1 and F2 are shown on FIG. 4.

This effect is enhanced, when filling the container 20 of the bottle 1 with a coloured liquid, since it produces optical effects that highlight the liquid, since the latter is overlapped on two laterally visible and distinguishable base fringes. This effect highlights the contents of the bottle, and it places the latter on two overlapping fringes that create a stand effect.

For a cylindrical bottle with a capacity of 750 millilitres like the one shown in FIG. 2A, a bottom wall 14 is proposed, by way of a non-limiting example, with an average thickness of the bottom wall G14 of 1.9 cm and with a diameter of 8.3 cm, a base tubular wall 15 with an average height of base wall A15 of 2.4 cm and with an average thickness of base wall G15 of 0.8 cm, and an average thickness of the receptacle tubular wall G10 of 0.4 cm.

In the alternative embodiment shown in FIG. 2B the average height of the base tubular wall A15, the average thickness of the base tubular wall G15, the average thickness of the bottom wall G14 and the average thickness of the receptacle tubular wall G10 are equal. In this embodiment the outer side 13 of the receptacle tubular wall 10 and the outer side of the base tubular wall 15 are tangent to each other being both surfaces coincident in an angle.

Figure 1:
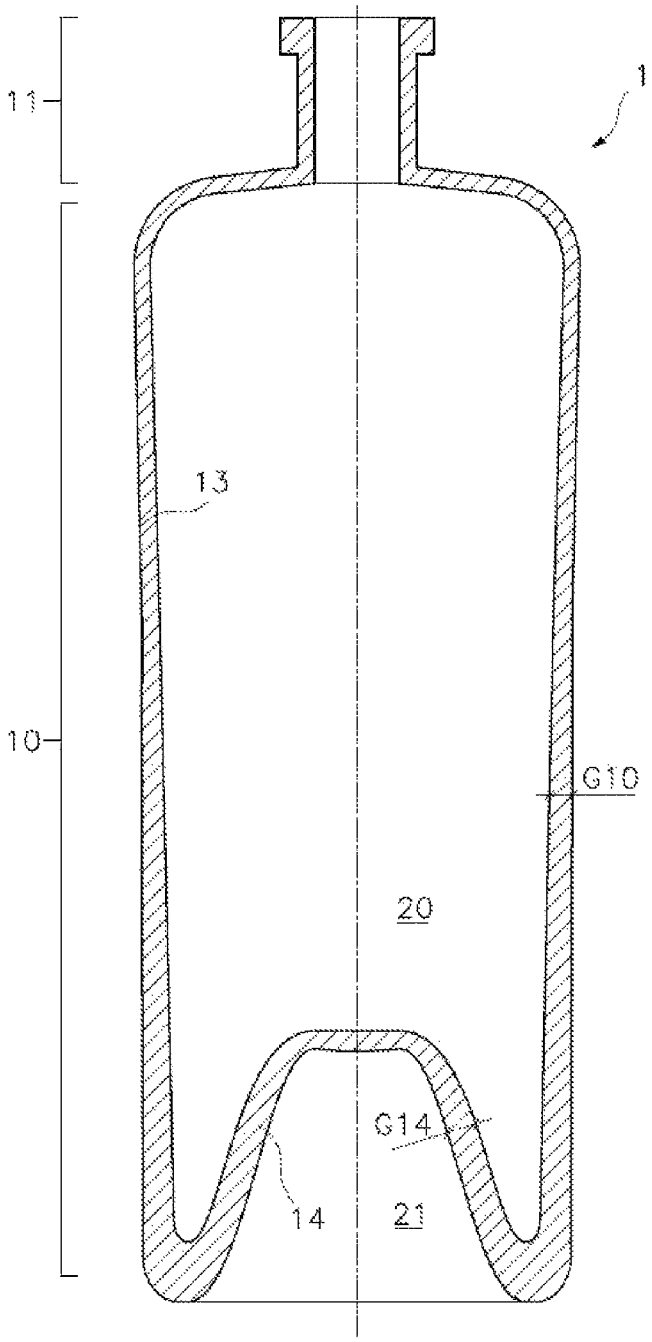
FIG. 1 shows a longitudinal section of a known state-of-the-art glass bottle provided with a bottom wall with a punt.

Said proposed bottles clearly differs from the bottles customary in the field shown in FIG. 1, by placing the entire bottle 1, including its bottom wall 14, on top of an extension of said bottom wall 14 in the shape of a base tubular wall 15, thereby raising the whole bottle 1 and its receptacle 20, which differs from the classical solution (FIG. 1) consisting of including a punt in the bottom wall that will enter the receptacle, thereby generating a double tubular wall in the bottom of the receptacle filled with liquid, thus increasing the interface of the liquid with the outside (and, as a result, speeding up their thermal exchange); in addition, the liquid introduced between both walls visually hides the punt of the bottom wall 14, which becomes invisible or hardly visible from the side of the bottle 1 in case of opaque or translucent liquids, thus producing no stand effect.

For the manufacture of said bottle 1 on an industrial scale, a mould 30 is required composed by at least three mutually attachable segments for making up an enclosure defined by inner mould walls 41 and a mould bottom 40. One first mould segment 31 makes up the mould bottom 40, and at least two other segments 32 and 33 make up the inner walls 41 of the mould, a deep perimeter annular groove 42 being left—defined between the first segment 31 and the at least two other mould segments 32 and 33—whose depth is equal to or larger than its average width. Said annular groove 42 will give shape the base tubular wall 15 after the moulding of the molten glass 50.

The mould also makes up the neck 11 of the bottle 1, and it is in that part of the mould where a blowing aperture 60 is contemplated.

The manufacturing procedure begins by arranging a predetermined amount of molten glass 50 inside the mould 30, said molten glass being preferably a parison provided with a neck 11, a receptacle tubular wall 10 and a bottom wall 14, and the receptacle of said parison being open to the outside through said neck, allowing the subsequent blowing of molten glass through said neck.

Then the closure of the mould is carried out around said predetermined amount of molten glass, leaving the neck 11 of the parison trapped inside the blowing aperture of the mould, and the blowing of the amount of molten glass is subsequently carried out through said neck 11 of the bottle 1, which is connected to blowing means. This expands the molten glass, expanding the receptacle 20, and applies and biases the molten glass against the walls and the bottom of the mould, shaping the bottle 1. In order to achieve the proper feeding of the molten glass into the deep annular perimeter groove, a partial vacuum is created by suctioning the air contained in said groove from its base through suction openings connected to suction means.

The viscosity of the molten glass, its temperature, the blowing time and pressure and its cooling speed are likewise adjusted in order to control the thickness of the tubular walls 10 of the receptacle and of the bottom wall 14. The greater the viscosity of the molten glass and the more slowly its cooling takes place, the more glass will flow to the base and the thicker the bottom wall 14 will be.

What is claimed is:

1. A glass bottle including at least a glass bottle body made up by a neck jointed in continuity to a receptacle tubular wall, said receptacle tubular wall defining an inner side and an outer side, and said bottle body being closed by a bottom wall, placed on a bottle body side which is opposite to said neck, defining a receptacle capable of holding liquids;

said receptacle tubular wall being joined to the perimeter of said glass bottom wall;

wherein the bottle further comprises a base tubular wall extending from a perimeter area of the bottom wall on a side of the bottom wall opposed to the receptacle tubular wall, said base tubular wall defining on its internal side, a cavity opened to the outside through a bottle distal end area opposite to said bottle neck, the glass bottle body, the bottom wall and the base tubular wall being made of a single glass piece; wherein the average height of the base tubular wall is equal to or larger than the average thickness of the base tubular wall, providing a visually distinguishable lateral apparent height of the base tubular wall and of the cavity, as seen laterally, produced by the luminous and light-diffracting properties of the base tubular wall with those proportions surrounding the cavity; and the average thickness of the bottom wall is equal to or larger than the average thickness of the base tubular wall, providing a visually distinguishable lateral apparent thickness of the bottom wall as seen laterally produced by the luminous and light-diffracting properties of the bottom wall with those proportions;

those proportions determining two overlapped visually distinguishable fringes as seen laterally on the lower end of the glass bottle, one first fringe corresponding to the lateral apparent height of the base tubular wall and the cavity as seen laterally and one second fringe corresponding to the lateral apparent thickness of the bottom wall as seen laterally.

2. The glass bottle according to claim 1 wherein the average height of the base tubular wall is equal to or larger than the average thickness of the base tubular wall in its proximal area of juncture with the bottom wall.

3. The glass bottle according to claim 1 wherein the bottom of the receptacle is concordant with one side of the bottom wall, and the bottom of the cavity is concordant with the other side of the bottom wall and are substantially parallel.

4. The glass bottle according to claim 1 wherein the average thickness of the bottom wall is equal to or larger than 1.5 times the average thickness of the base tubular wall.

5. The glass bottle according to claim 1 wherein the average thickness of the base tubular wall is equal to or larger than the average thickness of the receptacle tubular.

6. The glass bottle according to claim 1 wherein the average thickness of the base tubular wall is equal to or larger than 2 times the average thickness of the receptacle tubular wall.

7. The glass bottle according to claim 1 wherein the height of the base tubular wall is equal to or larger than the average thickness of the bottom wall.

8. The glass bottle according to claim 1 wherein the average height of the base tubular wall is equal to or larger than 1.5 times the average thickness of the bottom wall.

9. The glass bottle according to claim 1 wherein the outer side of the receptacle tubular wall and the outer side of the base tubular wall are mutually aligned and flush with the perimeter of the bottom wall.

10. The glass bottle according to claim 1 wherein the outer side of the receptacle tubular wall and the outer side of the base tubular wall are tangent to each other.

11. The glass bottle according to claim 1 wherein the outside opening of the cavity has a smaller or larger-sized surface than the size of the cross-section of the receptacle in a position adjacent to said bottom wall.

12. The glass bottle according to claim 1 wherein the receptacle tubular wall and/or the base tubular wall have a circular, elliptical, square or rectangular cross-section.

13. The glass bottle according to claim 1 wherein the volume of the cavity is at least 4% of the volume of the receptacle.

14. The glass bottle according to claim 1 wherein the volume of the cavity is at least 10% of the volume of the receptacle.

15. The glass bottle according to claim 1 wherein at least one rounded joint between the bottom wall and the receptacle tubular wall and/or between the bottom wall and the base tubular wall have a radius of curvature equal to or bigger than the average thickness of the bottom wall.

16. The glass bottle according to claim 1 wherein the bottom wall is flat or that said bottom wall has a radius of curvature equal to or longer than two or more times the average width of the hollow cavity.

17. The glass bottle according to claim 1 wherein at least one rounded joint between the bottom wall and the receptacle tubular wall and/or between the bottom wall and the base tubular wall have a radius of curvature equal to or bigger than half of the width of the hollow cavity.

18. The glass bottle according to claim 1 wherein the average width of the hollow cavity is bigger than the average height of the base tubular wall.

19. The glass bottle according to claim 1 wherein the center of the bottom of the hollow cavity is more distant to the opening of the cavity than the perimeter of the bottom of the receptacle.

* * * * *